United States Patent [19]

Brock

[11] Patent Number: 4,722,636

[45] Date of Patent: Feb. 2, 1988

[54] SELF-ADJUSTING, SELF-LEVELING TANDEM SCREED

[75] Inventor: J. Donald Brock, Chattanooga, Tenn.

[73] Assignee: Astec Industries, Inc., Chattanooga, Tenn.

[21] Appl. No.: 892,102

[22] Filed: Aug. 4, 1986

[51] Int. Cl.[4] ..... E01C 19/72

[52] U.S. Cl. ..... 404/84; 404/18

[58] Field of Search ..... 404/84, 96, 101, 102, 404/118, 108; 172/4, 5, 300, 470, 473, 489

[56] References Cited

U.S. PATENT DOCUMENTS

| | | | |
|---|---|---|---|
| 1,480,876 | 1/1924 | Berry | 172/489 X |
| 2,245,426 | 6/1941 | Baker | 404/102 |
| 2,289,168 | 7/1942 | Barber | 404/102 |
| 2,589,256 | 3/1952 | Horning | 404/101 X |
| 2,757,588 | 8/1956 | Pollitz | 404/114 |
| 3,111,070 | 11/1963 | Pollitz | 404/84 |
| 3,262,378 | 7/1966 | Schrimper et al. | 404/102 |
| 3,533,337 | 10/1970 | Swisher, Jr. | 404/118 |
| 3,691,916 | 9/1972 | Martenson et al. | 404/84 |
| 3,811,787 | 5/1974 | Beaty et al. | 404/118 |
| 3,841,777 | 10/1974 | Domenighetti | 404/84 |
| 3,957,384 | 5/1976 | Lamb et al. | 404/118 |
| 4,026,658 | 5/1977 | Neuendorf et al. | 404/84 |
| 4,129,399 | 12/1978 | Ruge | 404/118 |
| 4,379,653 | 4/1983 | Brown | 404/118 |
| 4,502,813 | 3/1985 | Hojberg | 404/102 |

FOREIGN PATENT DOCUMENTS

| | | | |
|---|---|---|---|
| 2555216 | 6/1977 | Fed. Rep. of Germany | 404/102 |
| PCT/CH79/-00092 | 2/1980 | PCT Int'l Appl. . | |

*Primary Examiner*—James A. Leppink
*Assistant Examiner*—Matthew Smith
*Attorney, Agent, or Firm*—Jones, Askew & Lunsford

[57] ABSTRACT

A tandem screed for use with a paving machine for compacting and smoothing asphalt paving composition includes a front screed mounted at the end of a towing arm and a rear screed mounted to the rear of the front screed and laterally extensible with respect thereto. A rear screed hydraulic cylinder is hooked up in series with a tow point hydraulic cylinder such that as the tow point is lowered, the rear screed is lowered with respect to the front screed; and as the tow point is raised, the rear screed is raised with respect to the front screed. The rear screed is thereby maintained at the same elevation as the front screed as the tow point is raised or lowered, thus avoiding bumps and irregularities in the pavement surface. In addition, self-leveling circuitry actuated by the stopping and restarting of the paving machine automatically brings the screeds to a level orientation with respect to the mat as the paving machine is stopped, and returns the screeds to their original angle of attack as the paving machine is restarted. In this manner, bumps in the mat resulting from stopping and restarting the paving machine are eliminated.

48 Claims, 11 Drawing Figures

SELF-ADJUSTING, SELF-LEVELING TANDEM SCREED

TECHNICAL FIELD

The present invention relates generally to screeds for smoothing and compacting asphalt paving material, and relates more specifically to a variable width screed wherein the rear screed is automatically self-adjusting as the front screed is raised and lowered, and wherein the screeds are automatically self-leveling when the paving machine is stopped.

BACKGROUND OF THE INVENTION

Screeds for use with paving machines for compacting and smoothing asphalt paving composition are well known. Typically, the screed is mounted behind the paving machine on the end of a towing arm, and the forward end of the towing arm can be raised and lowered to vary the angle of attack of the screed base plate with respect to the surface being paved. The paving machine lays down a mat of asphalt mix ahead of the screed, and the screed smooths and precompacts the mat. An automatic grade control regulates the thickness of the material placed into the road mat by raising and lowering the forward edge of the towing arm to vary the angle of attack of the screed base plate. As the tow point is lifted up, the leading edge of the screed is lifted up, causing more mix to go into the mat. As the tow point drops down, the leading edge of the screed drops down, causing less mix to go into the mat.

Where the desired width of the mat being laid is wider than the standard screed, a variable width screed is used. With this arrangement, a front or main screed is mounted to the rear end of the towing arm, and a rear of variable screed is attached to the rear of the main screed. The rear screed is laterally extensible to either side of the main screed to smooth and compact the mat beyond the outer edges of the main screed.

A number of fundamental problems occur when the variable width screed is added to the main screed. When the tow point is dropped down as required by the automatic grade control to reduce the thickness of the mat, the variable screed attached to the back of the main screed is forced to lift up, since the screeds rotate around the trailing edge of the main screed. Thus, while the main screed is being lowered to put less mix in the mat, the variable screed is being raised, which has the effect of placing more mix in the mat. Conversely, as the automatic grade control lifts the tow point, the screeds tend to rotate around the trailing edge of the rear screed, causing the rear screed to dig into the mat and lifting the front screed completely off the mat. Accordingly, any automatic adjustment by the grade control of the tow arm to adjust the angle of attack of the main screed causes the opposite reaction to occur with the variable screed.

Further, when width changes are made by extending the variable screeds outwardly, the weight of the two screeds remains constant, but the area of mix supporting the screeds increases. Therefore, the screeds can compact the mix less, causing the rear of the main screed to lift up and, therefore, the towing arm to drop down to compensate for it. This, in turn, causes the rear screed to raise up, again causing irregularities in the mat.

Accordingly, there is a need to provide a variable width screed which avoids irregularities in the mat resulting from the rear screed reacting oppositely to the front screed as the screeds are adjusted to vary the thickness of material going into the mat.

A further problem arises when screeds are stopped and restarted during the paving process. When the screeds are paving, they are running at a given angle of attack. As the paver stops at the end of one truckload of mix, and while the next truck is backing into position to deliver additional mix, the paver may be idle for some period of time, permitting the mix under the screed to become cold. Upon restarting, the screed can jump and slide on the ramp created by the angle of attack of the screeds against the mat. This causes too much mix to be placed in the mat directly ahead of the point where the screed was stopped.

Accordingly, there is a need to provide an automatic device that will avoid the uneven placement of mix in the mat when the paving machine is stopped and restarted.

SUMMARY OF THE INVENTION

As will be seen, the present invention overcomes these and other problems associated with prior art variable width screeds. Stated generally, the present invention comprises an apparatus for automatically adjusting the height of the rear screed as the tow point is raised or lowered, whereby the height of the rear screed with respect to the front screed is maintained constant as the angle of attack of the screeds is adjusted. In this manner, irregularities in the mat resulting from adjusting the screed to vary the thickness of material going into the mat are avoided. Further, the present invention includes an apparatus actuated in response to stopping the paving machine for bringing both screeds to a horizontal orientation, and for returning the screeds to their proper angle of attack upon restarting the paving machine. Thus, the uneven placement of mix in the mat when the paving machine is stopped and restarted is eliminated.

Stated somewhat more specifically, the present invention includes a towing arm having its forward end mounted to a paving machine at a tow point which is vertically adjustable with respect to the paving machine. A front or main screed is mounted at the rear end of the towing arm, and a rear or variable screed is mounted directly behind the front screed and laterally extensible to either side thereof. A tow point hydraulic cylinder raises and lowers the forward end of the towing arm with respect to the paving machine to control the angle of attack of the screeds. A hydraulic screed cylinder raises and lowers the rear screed with respect to the front screed. As the tow point cylinder is actuated to raise or lower the tow point, the screed cylinder is concurrently actuated to raise or lower the rear screed with respect to the front screed, thereby maintaining the rear screed at the same elevation as the front screed as the tow point is raised or lowered. Thus, as the grade control circuitry automatically adjusts the tow arm to adjust the angle of attack of the main screed, the variable screed is adjusted accordingly, rather than reacting oppositely, thereby avoiding irregularities in the mat.

As the paving machine is stopped, the tow point cylinder is automatically actuated to lower the tow point to bring the screeds to a horizontal orientation, and the screed cylinder is concurrently actuated to lower the rear screed with respect to the front screed. As the paving machine is restarted, the tow point cylinder is automatically actuated to return the screeds to their proper angle of attack, and the screed cylinder is concurrently actuated to raise the rear screed correspondingly with respect to the front screed. Thus, the "ramp" created by the angle of attack of the screed against the mat when the paving machine is stopped is eliminated, and the resulting uneven placement of mix ahead of the ramp when the paver is restarted is avoided.

Stated more specifically, the tow point hydraulic cylinder has a piston reciprocally mounted therein, with a lifting port on one end of the cylinder and a lowering port on the other. As hydraulic fluid is introduced into the cylinder through the lifting port, the piston is moved to raise the tow point, and a corresponding amount of hydraulic fluid is expelled through the lowering port. Similarly, the screed cylinder has a piston reciprocally mounted therein and lifting and lowering ports at opposite ends of the cylinder. In order to actuate the cylinders concurrently, the cylinders are connected in series by placing the lifting port of the tow point cylinder in fluid communication with the lowering port of the screed cylinder. Accordingly, as hydraulic fluid is introduced into the lowering port of the tow point cylinder to lower the tow point, hydraulic fluid is expelled through the lifting port of the tow point cylinder and introduced into the lowering port of the screed cylinder to lower the rear screed with respect to the front screed concurrently with the lowering of the tow point. Conversely, hydraulic fluid can be introduced into the lifting port of the screed cyinder, expelling fluid through the lowering port of the screed cylinder and introducing the expelled fluid into the lifting port of the tow point cylinder to raise the tow point concurrently with raising the rear screed.

To bring the screeds to a level position automatically upon stopping the paving machine, additional hydraulic circuitry including a driver cylinder and a leveling cylinder is provided. The driver cylinder has a piston reciprocally mounted therein and has a leveling port at one end of the cylinder and a return port at the other end. Similarly, the leveling cylinder has a piston mounted therein, with a return port at one end of the cylinder and a leveling port at the other end. A connecting rod connected to the driver cylinder piston is linked to the piston in the leveling cylinder, and a connecting rod projecting from the other end of the driver cylinder piston selectively engages a limit switch. As the paving machine stops, hydraulic fluid is injected into the leveling port of the driver cylinder, displacing the driver cylinder piston. The leveling cylinder piston, connected to the driver cylinder piston by the connecting rod, is thus also displaced, expelling hydraulic fluid through the leveling port of the leveling cylinder. This expelled fluid is introduced into the lowering port of the tow point cylinder, lowering the tow point. The screed cylinder, connected to the tow point cylinder in series as previously described is thereby actuated to lower the rear screed. The fluid thus expelled from the screed cylinder is introduced into the return port of the leveling cylinder. As the driver cylinder piston is displaced by an amount sufficient to bring the screeds to a level orientation, the limit switch is tripped, preventing further actuation of the tow point and screed cylinders. As the paving machine is restarted, hydraulic fluid is introduced into the driver cylinder through the return port, displacing the driver cylinder piston in the opposite direction. The hydraulic fluid which was originally expelled from the screed cylinder as the screed was lowered is now expelled from the leveling cylinder through the return port and back into the screed cylinder, lifting the screed to its original position. As the screed is lifted, the hydraulic fluid expelled from the screed cylinder is introduced through the lifting port of the tow point cylinder to raise the tow point to its original position. Since the amount of fluid returned to the tow point and screed cylinders is the same as the amount expelled during leveling, the screeds are returned to their original angle of attack.

Thus, it is an object of the present invention to provide an improved variable width screed.

It is another object of the present invention to provide a variable width screed wherein the variable screed can be extended without causing bumps and irregularities in the mat.

It is a further object of the present invention to provide a variable width screed wherein the rear screed does not react oppositely to the front screed as the angle of attack of the screeds is varied.

It is another object of the present invention to provide a variable width screed which eliminates bumps and irregularities in the mat as the paving machine is stopped and restarted.

Other objects, features, and advantages of the present invention will become apparent upon reading the following specification when taken into conjunction with the drawings and the appended claims.

DESCRIPTION OF THE DISCLOSED EMBODIMENT

Figure 1:
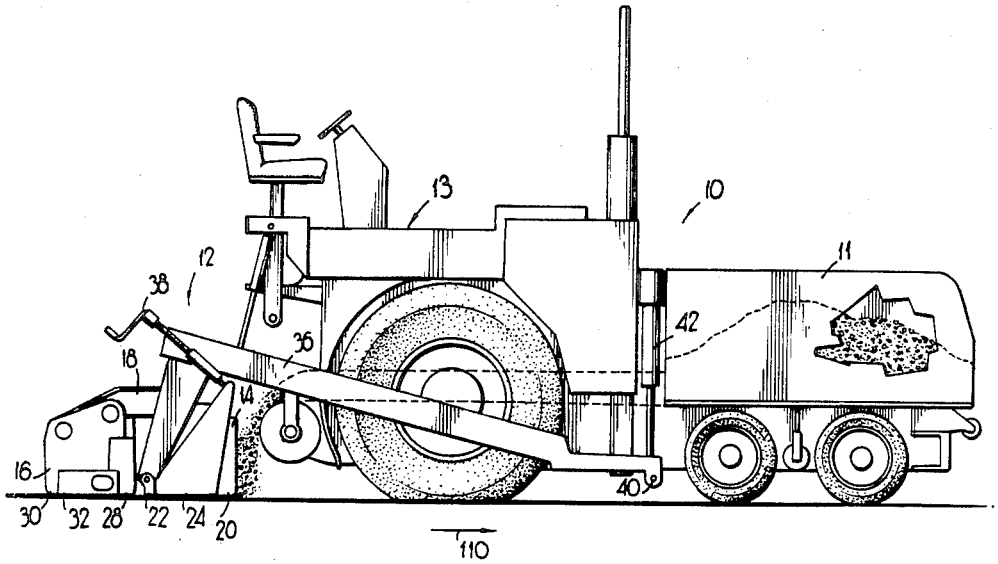
FIG. 1 is a side elevation of a paving machine having mounted thereto a self-adjusting, self-leveling variable-width screed according to the present invention.
Figure 2:
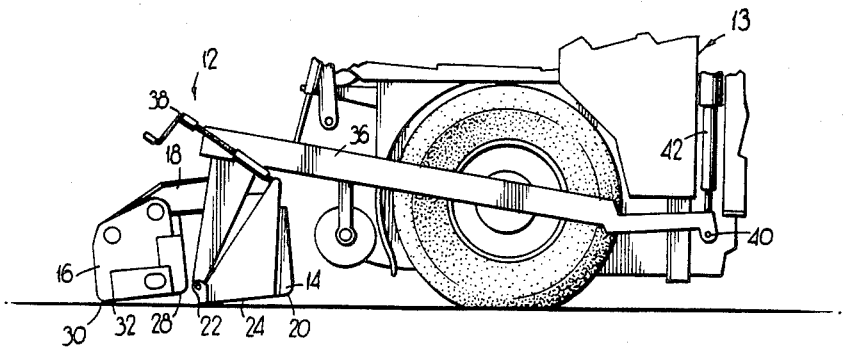
FIG. 2 is a side elevation view of the screed of FIG. 1 with the tow point raised.

Referring now in more detail to the drawing, in which like numerals indicate like elements throughout the several views, FIG. 1 shows a paving machine 10 including a tractor 11 having mounted thereto a self-adjusting variable-width tandem screed 12 according to the present invention. The tractor 11 contains the controls that regulate the flow of paving composition to the screed 12. The tractor has a hopper 13 into which asphaltic mixtures are deposited from a truck, and from which the material is carried back to the screed 12 by means of, for example, bar conveyors (not shown). The tractor 11 also provides the motive power not only for itself and the screed 12 but also to push the truck that is unloading into the hopper 13.

The tandem screed 12 includes a front or main screed 14 and a rear or variable screed 16 mounted behind the front screed by means of a rear screed support frame 18.

The front screed 14 has a leading edge 20, a trailing edge 22, and a base plate 24 comprising the lower face of the front screed. Similarly, the rear screed 16 includes a leading edge 28, a trailing edge 30, and a base plate 32 forming the lower face of the rear screed.

The tandem screed 12 is mounted to the tractor 11 by means of a towing arm 36. A hand crank 38 provides a means for manually adjusting the angle of the tandem screed 12 with respect to the towing arm 36. The forward end of the towing arm 36 is pivotally mounted to a tow point 40 at the lower end of a hydraulic tow point cylinder 42. The tow point cylinder, in turn, is mounted to the tractor 11 such that the tow point 40 is vertically adjustable with respect to the paving machine 10.

Figure 3:
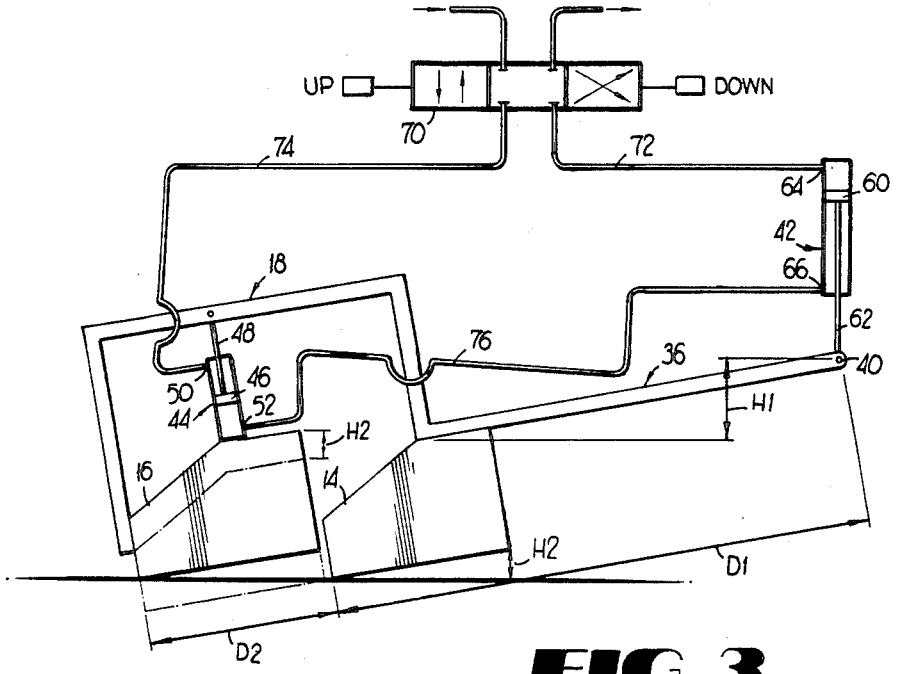
FIG. 3 is a schematic diagram of the self-adjusting hydraulic circuitry of the screed of FIG. 1 with the tow point raised.
Figure 4:
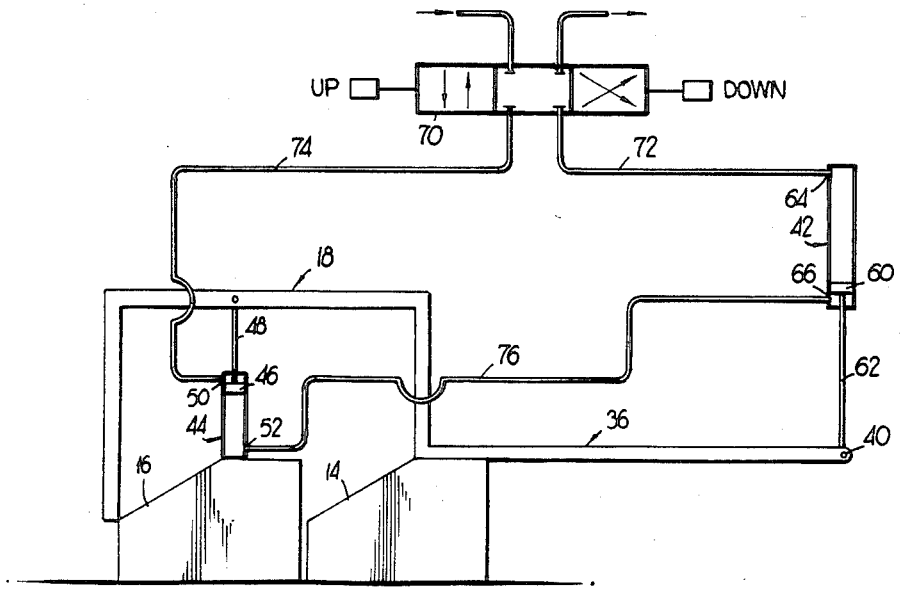
FIG. 4 is the schematic diagram of FIG. 3 showing the tow point lowered.

Referring now to FIGS. 3 and 4, the rear screed 16 is vertically adjustable with respect to the front screed 14 by means of a hydraulic screed cylinder 44. The screed cylinder 44 includes a piston 46 and rod 48 received therein for reciprocal motion. The upper end of the rod 48 is mounted to the rear screed support frame 18, and the lower end of the screed cylinder 44 is mounted to the rear screed 16. Thus, as the screed cylinder 44 is extended, the rear screed 16 is lowered, and as the screed cylinder is retracted, the rear screed is raised.

Hydraulic fluid can be introduced into or withdrawn from the screed cylinder 44 through a retraction or lifting port 50 in the upper end of the cylinder and through an extension or lowering port 52 in the lower end of the cylinder. As fluid is introduced into the lifting port 50, the piston 46 is displaced downwardly, retracting the rod 48 with respect to the screed cylinder 44 and lifting the rear screed 16 with respect to the front screed 14. As the piston 46 is displaced downwardly, a corresponding amount of hydraulic fluid is expelled through the lowering port 52 on the opposite end of the cylinder. When hydraulic fluid is introduced into the screed cylinder 44 through the lowering port 52, the piston 46 is displaced upwardly. The rod 48 is thereby extended with respect to the screed cylinder 44, lowering the rear screed 16 and expelling a corresponding amount of hydraulic flud through the lifting port 50 in the upper end of the cylinder.

In a similar manner, the tow point cylinder 42 has a piston 60 and rod 62 mounted for reciprocal movement within the cylinder. Hydraulic fluid is introduced into and withdrawn from the tow point cylinder 42 through an extension or lowering port 64 in the upper end of the cylinder and a retraction or lifting port 66 in the lower end of the cylinder. As hydraulic fluid is introduced into the tow point cylinder through the lowering port 64, the piston 60 is displaced downwardly, extending the rod 62 with respect to the cylinder and lowering the tow point 24. As the piston 60 is displaced, a corresponding amount of hydraulic fluid is expelled from the tow point cylinder through the lifting port 66. Conversely, when hydraulic fluid is introduced into the tow point cylinder 42 through the lifting port 66, the piston 60 is displaced upwardly and retracts the rod 62 with respect to the cylinder 42. A corresponding amount of hydraulic fluid is expelled through the lowering port 64 at the opposite end of the cylinder.

Hydraulic fluid is supplied to the tow point cylinder 42 and screed cylinder 44 by a conventioal hydraulic system including a fluid reservoir and pump (not shown). The flow of hydraulic fluid to and from the tow point cylinder 42 and screed cylinder 44 is controlled by a tow point valve 70. The tow point valve 70 is a three position four-way valve of conventional design. The tow point valve 70 is actuated by the automatic grade control of the paving machine in the manner well known to those skilled in the art. The tow point valve 70 is in fluid communication with the lowering port 64 of the tow point cylinder 42 by means of a hydraulic line 72, and is in fluid communication with the lifting port 50 of the screed cylinder 44 by means of a hydraulic line 74. The hydraulic circuit is completed by a hydraulic line 76 which places the lifting port 66 of the tow point cylinder 42 and the lowering port 52 of the screed cylinder 44 in fluid communication.

To pave a road surface with the paving machine 10 of the present invention, the tractor 11 moves forward in the direction indicated by the arrow 110 in FIG. 1. Asphaltic paving composition is delivered into the hopper 13 by a truck which moves into position just ahead of the tractor 11 and dumps its contents into the hoper as the paving machine is moving forward. The paving composition is carried by the bar conveyors from the hopper 13 to a point just ahead of the tandem screed 12, where it is placed in a mat on the underlying road surface. The tandem screed 12 then smooths and compacts successive portions of the mat as the paving machine 10 moves forward.

Figure 5A:
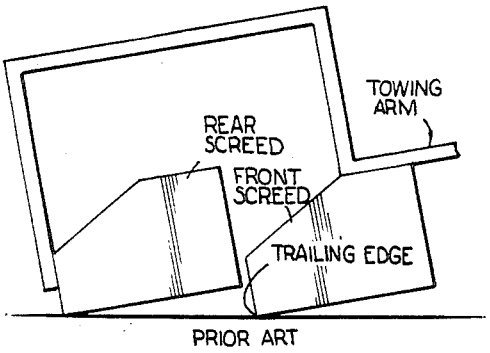
FIGS. 5A–B are schematic representations of a prior art variable-width screed.
Figure 5B:
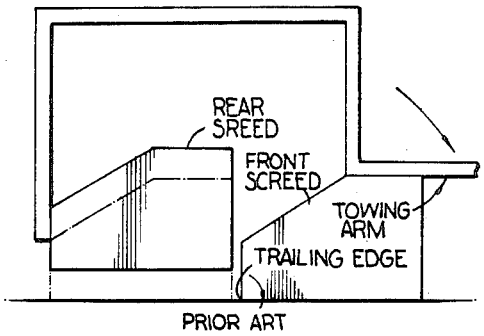

The operation of the variable-width tandem screed 12 of the present invention can best be appreciated in the context of an understanding of prior art variable-width screeds. FIGS. 5A and 5B show a schematic representation of a conventional tandem screed including a front screed mounted on the end of a towing arm, and a rear screed mounted directly behind the front screed. In FIG. 5A, the towing arm is raised to position the screeds at a desired angle of attack with respect to the ground. With the tow point raised as shown in FIG. 5A, the leading edge of the screeds are lifted up, causing more mix to go into the mat.

In FIG. 5B, the towing arm is lowered, such as would occur when the automatic grade control attempts to reduce the thickness of the mat. As can be seen, the screeds rotate around the trailing edge of the front screed, causing the rear screed to lift off the ground. Thus, while the front screed is attempting to put less mix into the mat, the lifting of the rear screed has the effect of putting more mix into the mat. The phantom lines in FIG. 5B indicate the proper position of the rear screed.

Referring now to the operation of the tandem screed 12 of the present invention, when the automatic grade control circuitry senses a need to reduce the thickness of the mat, the angle of attack of the screeds with respect to the mat must be reduced, thereby placing less mix into the mat. To accomplish this, the tow point valve 70 is actuated to introduce hydraulic fluid through the hydraulic line 72 into the lowering port 64 of the tow point cylinder 42. The piston 60 is displaced downwardly within the tow point cylinder 42, expelling a corresponding amount of hydraulic fluid through the lifting port 66 at the opposite end of the tow point cylinder. As the piston 60 is displaced downwardly, the tow point 24 at the opposite end of the piston rod 62 is correspondingly lowered, reducing the angle of attack of the front screed 14 at the rear of the towing arm 36. As the front screed 14 rotates around its rear edge 22, the rear screed 16 tends to be lifted off the mat. Without adjustment, the rear screed would assume the position of the prior art rear screed in FIG. 5B.

To counteract this tendency for the rear screed to lift off the mat as the front screed is lowered, the hydraulic fluid expelled through the lifting port 66 of the tow point cylinder 42 is carried through the hydraulic line 76 and introduced into the lowering port 52 of the screed cylinder 44. As the hydraulic fluid is introduced into the screed cylinder, the screed cylinder piston 46 is displaced upwardly, extending the piston rod 48 with respect to the cylinder. This has the effect of lowering the rear screed with respect to the front screed. A corresponding amount of hydraulic fluid is expelled through the lifting port 50 of the screed cylinder 44 and conveyed back through the hydraulic line 74 to the hydraulic fluid reservoir.

In contrast, when it is necessary to raise the tow point 40 to place more mix into the mat, the screeds would tend to rotate around the trailing edge 30 of the rear screed 16, causing the rear screed to dig into the mat and the front screed to be raised off the mat. To counteract this action, when the automatic grade control dictates more mix to be placed into the mat, the tow point valve 70 introduces hydraulic fluid through the hydraulic line 74 into the lifting port 50 of the screed cylinder 44. The screed cylinder piston 46 is displaced downwardly, lifting the rear screed 16 with respect to the front screed 14, and expelling a corresponding amount of hydraulic fluid through the lowering port 52 at the opposite end of the screed cylinder 44. The expelled fluid is conducted through the hydraulic line 76 and introduced into the lifting port 66 of the tow point cylinder 42. The tow point piston 60 is displaced upwardly within the tow point cylinder 42, raising the tow point 40 at the end of the piston rod 62. The hydraulic fluid thereby expelled through the lowering port 64 of the tow point cylinder 42 is returned to the fluid reservoir through the hydraulic line 72. Thus, as the tow point is raised, the rear screed is raised concurrently therewith to maintain the trailing edge of the rear screed at an equal elevation with the trailing edge of the front screed 14. In this manner, the same amount of mix is placed into the mat by the rear screed as by the front screed, avoiding the irregularities associated with adjusting prior art variable-width screeds.

By controlling the relative diameters of the tow point and screed cylinders 42, 44, it is possible to control the elevation of the rear screed with respect to the front screed as the tow point is raised or lowered such that the trailing edge 30 of the rear screed is maintained at the same elevation as the trailing edge 22 of the main screed 14. As can be seen with reference to FIG. 3, in order for the trailing edge 30 of the rear screed 16 to be maintained at the same elevation as the trailing edge 22 of the front screed 14 as the screeds are brought from a level orientation to a desired angle of attack, the rear screed 16 must be raised with respect to the front screed 14 by a distance equal to the distance by which the front edge 20 of the front screed is raised. With particular reference to FIG. 3, as the tow point 40 is raised by a height H1, the leading edge 20 of the front screed 14 is raised by a height H2, and the rear screed 16 must also be raised by the height H2. Since the distance D1 from the tow point 40 to the trailing edge 22 of the front screed 14 can be measured, and since the distance D2 from the trailing edge of the front screed to the trailing edge 30 of the rear screed 16 is also fixed, the ratio between the heights H1 and H2 can be expressed as follows: $H1/H2=D1/D2$. Thus, for example, if the distance D1 is six times longer than the distance D2, the rear screed must be raised by one-sixth the distance by which the tow point is raised. Since the same amount of hydraulic fluid must raise the tow point six times farther than the rear screed is raised, the cross-sectional area of the tow point cylinder 42 would have to be one-sixth the cross-sectional area of the screed cylinder 44. Thus, by controlling the relative diameters of the hydraulic cylinders in proportion to the distances D1 and D2, the proper elevation of the rear screed with respect to the front screed can be maintained as the tow point is raised or lowered.

Figure 6:
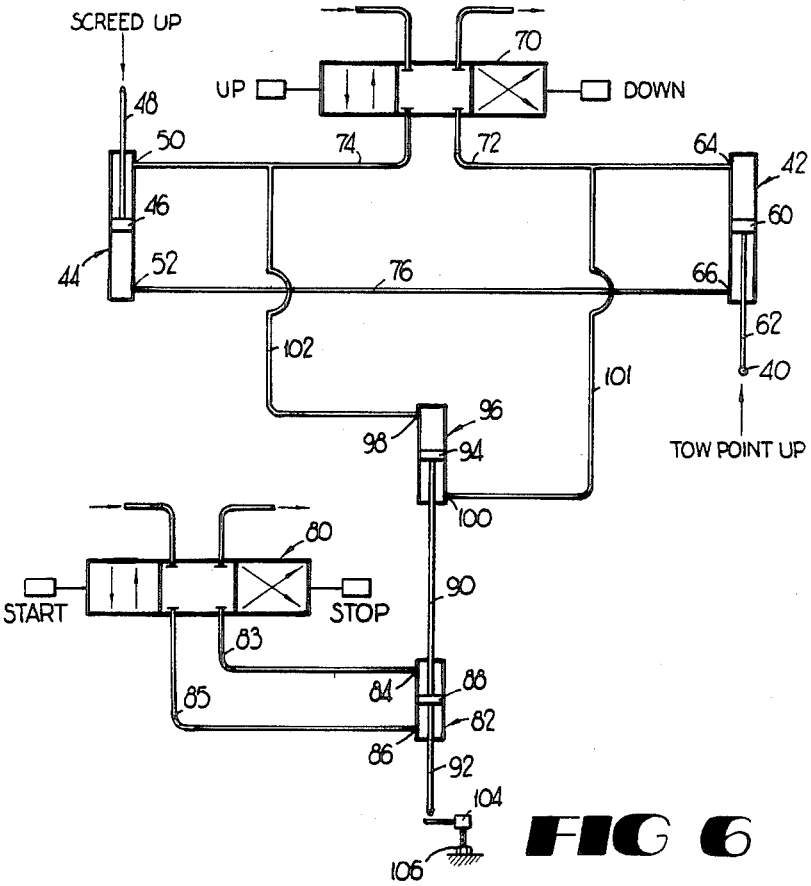
FIG. 6 is a schematic diagram of the self-leveling and self-adjusting hydraulic circuitry of the screed of FIG. 1.

Referring now to FIG. 6, the variable-width screed of the present invention further comprises self-leveling circuitry for leveling the screeds as the paver is brought to a stop, and for returning the screeds to their previous angle of attack when the paver is restarted. A leveling valve 80 comprising a conventioal three position four-way hydraulic valve is actuated in response to the stopping and restarting of the tractor. The leveling valve 80 controls the flow of hydraulic fluid to a hydraulic driver cylinder 82. When the leveling valve 80 is actuated to the right from its neutral position as shown in FIG. 6, a flow of hydraulic fluid is directed through a hydraulic line 83 and into a leveling port 84 in the upper end of the driver cylinder 82. When the leveling valve 80 is actuated to its left position, a flow of hydraulic fluid is directed through a hydraulic line 85 and into the return port 86 in the lower end of the driver cylinder 82. As hydraulic fluid is introduced into one of the ports 84, 86, a piston 88 is displaced within the driver cylinder 82, and a corresponding amount of hydraulic fluid is expelled through the opposite port.

The driver cylinder piston 88 has upper and lower connecting rods 90, 92 extending from either end thereof. The other end of the upper rod 90 is connected to a piston 94 within a leveling cylinder 96. The leveling cylinder 96 has a return port 98 in its upper end and a leveling port 100 in its lower end through which hydraulic fluid can be introduced into or expelled from the leveling cylinder. The leveling port 100 is in fluid communication with the lowering port 64 of the tow point cylinder 42 by means of a hydraulic line 101, and the return port 98 of the leveling cylinder is in fluid communication with the lifting port 50 of the screed cylinder 44 by means of a hydraulic line 102.

The lower driver cylinder piston rod 92 is operatively associated with a limit switch 104 mounted in fixed relation to the driver cylinder 82. As the driver cylinder piston 88 is displaced downwardly, the lower end of the lower piston rod 92 engages the limit switch 104. The limit switch 104 actuates the leveling valve 80 back to its normal center position. A screw adjustment 106 adjusts the clearance between the lower piston rod 92 and the limit switch 104 to control the distance through which the driver cylinder piston 88 is displaced before the leveling valve is actuated back to its normal position.

Figure 7A:
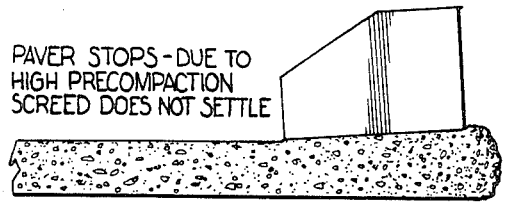
PRIOR ART FIG 7A
FIGS. 7A–7D are schematic diagrams illustrating the effect on the surface being paved of stopping and restarting a prior art screed.
Figure 7B:
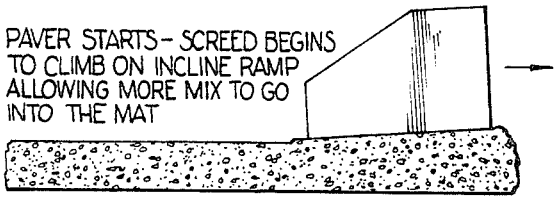
PRIOR ART FIG 7B

The operation of the self-leveling circuitry can best be appreciated in the context of an understanding of the problems associated with prior art screeds. FIG. 7 shows a prior art screed oriented at an angle of attack with respect to a mat being laid. As shown in FIG. 7A, when the paver stops, due to high precompaction, the screed does not settle. While the paver is stopped, the mix underneath the screed cools, forming a ramp. When the paver restarts, as shown in FIG. 7B, the screed climbs on the ramp, allowing more mix to go into the mat just ahead of the ramp.

Figure 7C:
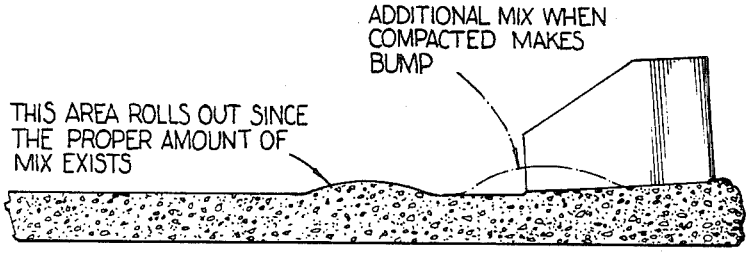
PRIOR ART FIG 7C
Figure 7D:
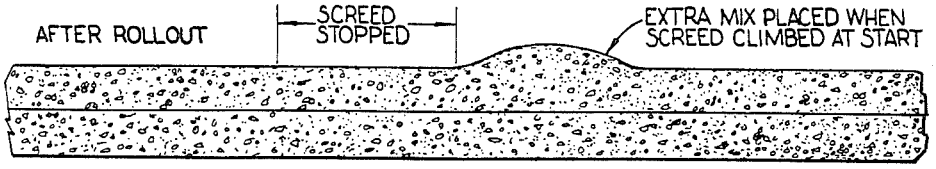
PRIOR ART FIG 7D

Referring now to FIG. 7C and 7D, the ramp formed at the point where the screed was stopped will roll out flat, since the proper amount of mix was placed into the mat at that point. However, at a point just ahead of the ramp, where extra mix was placed when the screed climbed at startup, a bump is formed which will not roll out.

It will thus be appreciated that the placement of the extra mix in the mat just ahead of where the screed had stopped is the result of the screed climbing up the ramp formed by the angle of attack of the screed against the mat. Accordingly, if the ramp can be eliminated, no extra mix will be placed in the mat when the screed restarts, and the bump will be eliminated. The self-leveling circuitry of the present invention achieves elimination of the ramp by automatically bringing the screeds to a level orientation with respect to the mat when the paver stops, and returning the screeds to their proper angle of attack when the paver is restarted.

Referring again to FIG. 6, when the operator pulls the control lever back to a neutral position to stop the paver, a limit switch is actuated which automatically actuates the leveling valve 80 to its right position to direct hydraulic fluid through the hydraulic line 83 and into the driver cylinder 82 through the leveling port 84. As the fluid is introduced into the cylinder, the driver cylinder piston 88 is displaced downwardly. The leveling cylinder piston 94, connected to the driver cylinder piston 88 by the connecting rod 90, is also displaced downwardly, expelling hydraulic fluid from the lower end of the leveling cylinder 96 through the leveling port 100. The expelled hydraulic fluid is conducted by the hydraulic line 101 and introduced into the lowering port 64 of the tow point cylinder 42, causing the tow point 24 to be lowered in the manner hereinabove described. A corresponding amount of hydraulic fluid is expelled through the lifting port 66 in the opposite end of the tow point cylinder 42 and communicated through the line 76 into the lowering port 52 in the lower end of the screed cylinder 44. The screed cylinder piston 46 is thereby displaced upwardly, lowering the screed and expelling a corresponding amount of hydraulic fluid through the lifting port 50. The hydraulic fluid thus expelled is returned by the hydraulic line 102 and introduced through the return port 98 in the upper end of the leveling cylinder 96. When the driver cylinder piston 88 has been displaced downwardly by the desired amount, the lower connecting rod 92 trips the limit switch 104, actuating the leveling valve to return to its normal center position.

As the paver is restarted, the leveling valve 80 is actuated to its left position to direct hydraulic fluid through the hydraulic line 85 and into the lower end of the driver cylinder 82 through the return port 86. As the fluid is introduced into the driver cylinder 82, the driver cylinder piston 88 is displaced upwardly. The leveling cylinder piston 94 at the other end of the upper connecting rod 90 is also displaced upwardly, expelling hydraulic fluid from the leveling cylinder 96 through the return port 98. The expelled fluid is conducted by the hydraulic line 102 and introduced into the lifting port 50 of the screed cylinder 44, raising the screed in the manner hereinabove described, and the tow point cylinder 42 connected in series with the screed cylinder 44 is concurrently actuated, raising the tow point 24 in the manner hereinabove described. Since the hydraulic fluid in the upper end of the leveling cylinder 96 is the hydraulic fluid expelled from the screed cylinder 44 as the screeds were leveled, it will be appreciated that the return of that same hydraulic fluid into the screed cylinder by the upward displacement of the leveling cylinder piston 94 will be exactly enough to return the tow point and screeds to their orientation before the paver was stopped.

While the self-adjusting circuitry of the present invention is disclosed with respect to the lifting port 66 of the tow point cylinder 42 being in fluid communication with the lowering port 52 of the screed cylinder 44, it will be appreciated that the same result can be achieved by placing the lifting port 50 of the screed cylinder in fluid communication with the lowering port 64 of the tow point cylinder. With such an arrangement, to raise the tow point 24, the tow point valve 70 would cause hydraulic fluid to be introduced into the lifting port 66 of the tow point cylinder 42 to raise the tow point, with the hydraulic fluid expelled through the lowering port 64 of the tow point cylinder being introduced into the lifting port 50 of the screed cylinder 44 to raise the rear screed. Similarly, to lower the tow point with such an arrangement, the tow point valve 70 would cause hydraulic fluid to be introduced into the lowering port 52 of the screed cylinder 44 to lower the rear screed, the hydraulic fluid expelled through the lifting port 50 of the screed cylinder being introduced into the lowering port 64 of the tow point cylinder 42 to lower the tow point.

While the variable-width screed of the present invention is disclosed with respect to an embodiment including both the self-adjusting and self-leveling features working in cooperation, it will be appreciated that an improved variable-width tandem screed may be provided which includes only the self-adjusting feature of the present invention. Similarly, the self-leveling feature may be incorporated into a fixed-width single screed to eliminate the bumps caused by the ramps which form when the paving machine stops and restarts.

Finally, it will be understood that the preferred embodiment of the present invention has been disclosed by way of example, and that other modifications may occur to those skilled in the art without departing from the scope and spirit of the appended claims.

I claim:

1. An apparatus for attachment to a paving machine for spreading and smoothing paving composition and the like, comprising:

a front screed having a leading and a trailing edge;

means for mounting said front screed to the rear of said paving machine;

a rear screed having a leading and a trailing edge, said rear screed being mounted to the rear of said paving machine and behind said front screed for substantially vertical movement with respect to said front screed;

a first means operatively associated with said front screed for modifying the angle of attack of said front screed with respect to a surface being paved; and a second means, operatively associated with said rear screed and actuated substantially concurrently with actuation of said first means, for raising and lowering said rear screed with respect to said front screed.

2. The apparatus of claim 1, wherein said means for mounting said front screed to the rear of said paving machine comprises:

a towing arm having forward and back ends, said front screed being mounted to the back end of said towing arm; and means for mounting the forward end of said towing arm to said paving machine at a tow point vertically moveable with respect to said paving machine.

3. The apparatus of claim 2, wherein said first means for modifying the angle of attack of said front screed with respect to said surface being paved comprises a first means for raising and lowering said tow point with respect to said paving machine, whereby the forward end of said towing arm is raised and lowered to control the angle of said front screed with respect to said surface being paved.

4. The apparatus of claim 1, wherein said rear screed is laterally extensible with respect to said front screed.

5. The apparatus of claim 1, wherein said second means raises and lowers said rear screed with respect to said front screed such that the trailing edge of said rear screed is maintained at an equal elevation to the trailing edge of said front screed with respect to a surface being paved as said angle of attack of said front screed is modified.

6. The apparatus of claim 1, wherein the distance by which said second means raises and lowers said rear screed with respect to said front screed is equal to the distance by which the leading edge of said front screed is raised or lowered as said angle of attack of said front screed is modified, multiplied by the ratio of the distance from the leading edge of said front screed to the trailing edge thereof to the distance between the trailing edge of said front screed to the trailing edge of said rear screed, whereby the trailing edge of said rear screed is maintained at an equal elevation to the trailing edge of said front screed.

7. The apparatus of claim 3, wherein said first and second raising and lowering means comprise first and second hydraulic cylinders.

8. The apparatus of claim 7, wherein said second hydraulic cylinder actuated concurrently with actuation of said first hydraulic cylinder comprises said second hydraulic cylinder being connected in series with said first hydraulic cylinder.

9. The apparatus of claim 8, wherein the ratio of the diameter of said first hydraulic cylinder to said second hydraulic cylinder is equal to the ratio of the distance between the tow point and the trailing edge of said front screed to the distance between the trailing edge of said front screed and the trailing edge of said rear screed, whereby said rear screed is raised and lowered with respect to said front screed by a distance equal to the distance by which the leading edge of said front screed is raised or lowered.

10. The apparatus of claim 1, further comprising self-leveling means, operatively associated with said first and second means, for actuating said first means for modifying the angle of attack of said front screed to modify said angle of attack to bring said front screed from a paving orientation to a stopped orientation with respect to the surface being paved, and for concurrently actuating said second means for raising and lowering said rear screed with respect to said front screed to lower said rear screed from a first position to a second position with respect to said front screed.

11. The apparatus of claim 10 wherein said self-leveling means is actuated in response to said paving machine stopping its forward movement.

12. The apparatus of claim 1, further comprising return means, operatively associated with said first and second means, for actuating said first means for modifying the angle of attack of said front screed to modify said angle of attack to return said front screed from said stopped orientation to said paving orientation, and for concurrently actuating said second means for raising and lowering said rear screed with respect to said front screed to raise said rear screed from said second position to said first position with respect to said front screed.

13. The apparatus of claim 12, wherein said return means is actuated in response to said paving machine restarting its forward movement.

14. An apparatus for attachment to a paving machine for spreading and smoothing paving composition and the like, comprising:

a towing arm having a forward portion;

means for mounting the forward portion of said towing arm to said paving machine at a tow point vertically moveable with respect to said paving machine;

a front screed having a leading and a trailing edge, said front screed being mounted to said towing arm at a point thereon rearward of said tow point;

a rear screed having a leading and a trailing edge, said rear screed being mounted to said towing arm behind said front screed for substantially vertical movement with respect to said front screed;

a hydraulic tow point cylinder operatively associated with said towing arm and having a first piston mounted therein for reciprocal motion, said tow point cylinder being operative upon actuation thereof to raise and lower said tow point with respect to said paving machine;

a hydraulic screed cylinder operatively associated with said rear screed and having a second piston mounted therein for reciprocal motion, said screed cylinder being operative upon actuation thereof to raise and lower said rear screed with respect to said front screed;

means for introducing hydraulic fluid into said tow point cylinder on one side of said first piston to raise said tow point with respect to said paving machine, and for introducing hydraulic fluid into said tow point cylinder on the other side fo a said first piston to lower said tow point with respect to said paving machine; and means for introducing hydraulic fluid into said screed cylinder on one side of said second piston to raise said rear screed with respect to said front screed concurrently with said introduction of hydraulic fluid into said tow point cylinder on said one side of said first piston, and for introducing hydraulic fluid into said screed cylinder on the other side of said second piston to lower said rear screed with respect to said front screed concurrently with said introduction of hydraulic fluid into said tow point cylinder on said other side of said first piston, whereby said rear screed is raised concurrently with said tow point being raised and lowered concurrently with said tow point being lowered.

15. The apparatus to claim 14, wherein said rear screed is laterally extensible with respect to said front screed.

16. The apparatus of claim 14, wherein said means for introducing hydraulic fluid into said screed cylinder concurrently with said introduction of hydraulic fluid into said tow point cylinder comprises connecting said cylinders in series.

17. The apparatus of claim 14, wherein a sufficient quantity of hydraulic fluid is introduced into said screed cylinder to raise and lower said rear screed with respect to said front screed such that the trailing edge of said rear screed is maintained at an equal elevation to the trailing edge of said front screed with respect to a surface being paved as said tow point is raised and lowered.

18. The apparatus of claim 14, further comprising:

means actuated in response to stopping said paving machine for introducing hydraulic fluid into said tow point cylinder on said other side of said first piston to lower said tow point from a first tow point position to a second tow point position with respect to said paving machine to bring said front screed from a paving orientation to a stopped orientation; and means for concurrently introducing a quantity of hydraulic fluid into said screed cylinder on said other side of said second piston to lower said rear screed from a first rear screed position to a second rear screed position with respect to said front screed.

19. The apparatus of claim 18, further comprising:

means actuated in response to restarting said paving machine for introducing a quantity of hydraulic fluid into said tow point cylinder on said one side of said first piston to raise said tow point from said second tow point position to said first tow point position to return said front screed from said stopped orientation to said paving orientation; and means for concurrently introducing a quantity of hydraulic fluid into said screed cylinder on said one side of said second piston to return said rear screed from said second position to said first position with respect to said front screed concurrently with said raising of said tow point.

20. An apparatus for attachment to a paving machine for spreading and smoothing paving composition and the like, comprising:

a towing arm having a forward portion;

means for mounting the forward portion of said towing arm to said paving machine at a tow point;

a front screed having a leading and a trailing edge, said screed being mounted to said towing arm at a point thereon rearward of said tow point;

a rear screed mounted to said towing arm behind said front screed for substantially vertical movement with respect to said front screed and laterally extensible to either side thereof;

a hydraulic tow point cylinder operatively associated with said towing arm and having a first piston mounted therein for reciprocal motion, said tow point cylinder having a first lifting port on one side of said first piston and a first lowering port on the other side of said first piston such that a hydraulic fluid introduced into one of said first ports moves said first piston and expels fluid from the other of said first ports, said tow point cylinder being operative upon introduction of hydraulic fluid into said tow point hydraulic cylinder through said first lifting port to raise said tow point with respect to said paving machine and operative upon introduction of hydraulic fluid into said tow point hydraulic cylinder through said first lowering port to lower said tow point with respect to said paving machine, whereby the forward end of said towing arm is raised and lowered to control the angle of said front screed with respect to a surface being paved;

a hydraulic screed cylinder operatively associated with said rear screed and having a second piston mounted therein for reciprocal motion, said screed cylinder having a second lifting port on one side of said second piston and a second lowering port of the other side of said second piston such that a hydraulic fluid introduced into one of said second ports moves said second piston and expels fluid from the other of said second ports, said screed cylinder being operative upon introduction of hydraulic fluid into said screed cylinder through said second lifting port to raise said rear screed with respect to said front screed and operative upon introduction of hydraulic fluid into said screed cylinder through said second lowering port to lower said rear screed with respect to said front screed;

means for placing the lowering port of one of said tow point or screed cylinders in fluid communication with the lifting port of the other of said cylinders; and means for selectively introducing hydraulic fluid into the lifting port of said one cylinder, whereby a corresponding amount of hydraulic fluid is expelled from the lowering port of said one cylinder and introduced through said fluid communication means into said lifting port of said other cylinder such that said rear screed is raised with respect to said front screed concurrently with said tow point being raised with respect to said paving machine.

21. The apparatus of claim 20, wherein said rear screed is laterally extensible with respect to said front screed.

22. The apparatus of claim 20, further comprising means for selectively introducing hydraulic fluid into said lowering port of said other cylinder, whereby a corresponding amount of hydraulic fluid is expelled from said lifting port of said other cylinder and introduced through said fluid communication means into said lowering port of said one cylinder such that said tow point is lowered with respect to said paving machine concurrently with said rear screed being lowered with respect to said front screed.

23. The apparatus of claim 22, wherein the ratios of the diameters of said tow point cylinder and said screed cylinder are controlled such that the quantity of fluid expelled from one of said cylinders and introduced through said fluid communication means into the other of said cylinders is such that the trailing edge of said rear screed is maintained at an equal elevation to the trailing edge of said front screed with respect to a surface being paved as said tow point is raised and lowered.

24. The apparatus of claim 22, wherein said means for selectively introducing a quantity of hydraulic fluid into said lowering port of said other cylinder is actuated in response to stopping said paving machine such that as said paving machine is stopped said rear screed is lowered from a first rear screed position to a second rear screed position with respect to said front screed, and such that said tow point is lowered from a first tow point position to a second tow point position with respect to said paving machine to bring said front screed from a paving orientation to a stopped orientation concurrently with said lowering of said rear screed.

25. The apparatus of claim 24, wherein said means for selectively introducing a quantity of hydraulic fluid into said lifting port of said one cylinder is actuated in response to restarting said paving machine such that upon restarting said paving machine said tow point is raised from said second tow point position to said first to point position to return said front screed from said stopped orientation to said paving orientation, and such that said rear screed is returned from said second rear screed position to said first rear screed position concurrently with said raising of said tow point.

26. The apparatus of claim 24, wherein the hydraulic fluid which is expelled from said lifting port of said one cylinder is stored in a reservoir reserved exclusively for said expelled fluid.

27. The apparatus of claim 26, wherein said stored expelled fluid is reintroduced from said reservoir into said lifting port of said one cylinder in response to restarting said paving machine, a corresponding amount of hydraulic fluid being expelled from said lowering port of said one cylinder and introduced through said fluid communication means into said lifting port of said other cylinder such that said tow point is raised from said second tow point position to said first tow point position to return said front screed from said stopped orientation to said paving orientation, and such that said rear screed is returned from said second rear screed position to said first rear screed position concurrently with said raising of said tow point.

28. An apparatus for attachment to a paving machine for spreading and smoothing paving composition and the like, comprising:

a front screed having a leading and a trailing edge;

mounting means for mounting said front screed to the rear of said paving machine;

a rear screed having a leading and a trailing edge, said rear screed being mounted to the rear of said paving machine behind said front screed for substantially vertical movement with respect to said front screed;

angle of attack modification means operatively associated with said front screed for modifying the angle of attack of said front screed to bring said front screed from a paving orientation to a stopped orientation with respect to a surface being paved; and vertical adjustment means operatively associated with said rear screed and actuated substantially concurrently with the actuation of said angle of attack modification means for vertically adjusting said rear screed from a first position to a second position with respect to said front screed.

29. The apparatus of claim 28, wherein said angle of attack modification means for modifying the angle of attack of said front screed and said vertical adjustment means for vertically adjusting said rear screed are actuated in response to said paving machine stopping its forward movement.

30. The apparatus of claim 28, further comprising:

front screed return means operatively associated with said front screed for returning said front screed from said stopped orientation to said paving orientation with respect to said surface; and rear screed return means operatively associated with said rear screed and actuated substantially concurrently with the actuation of said front screed return means for returning said rear screed from said second position to said first position.

31. The apparatus of claim 30, wherein said front screed return means and said rear screed return means are actuated in response to said paving machine restarting its forward movement.

32. A paving machine for spreading and smoothing a paving composition on a road surface, comprising:

tractor means for providing motive power;

means associated with said tractor means for receiving said paving composition and for depositing said paving composition onto the underlying road surface;

a towing arm having a forward portion;

means for mounting the forward portion of said towing arm to said tractor means at a tow point vertically moveable with respect to said tractor means;

a front screed having a leading and a trailing edge, said front screed being mounted to said towing arm at a point thereon rearward of said tow point, said front screed being disposed rearwardly of the location at which said paving composition is deposited onto said underlying road surface by said receiving and depositing means;

a rear screed having a leading and a trailing edge, said rear screed being mounted to said tractor means behind said front screed for substantially vertical movement with respect thereto;

a first means operatively associated with said towing arm for raising and lowering said tow point with respect to said tractor means, whereby the forward end of said towing arm is raised and lowered to control the angle of said front screed with respect to a surface being paved; and a second means, operatively associated with said rear screed and actuated concurrently with actuation of said first means, for raising and lowering said rear screed with respect to said front screed.

33. The paving machine of claim 32, wherein said rear screed is laterally extensible with respect to said front screed.

34. The paving machine of claim 32, wherein said second means raises and lowers said rear screed with respect to said front screed such that the trailing edge of said rear screed is maintained at an equal elevation to the trailing edge of said front screed with respect to a surface being paved as said tow point is raised and lowered.

35. The paving machine of claim 32, wherein the distance by which said second means raises and lowers said rear screed with respect to said front screed is equal to the distance by which the leading edge of said front screed is raised or lowered multiplied by the ratio of the distance from the leading edge of said front screed to the trailing edge thereof to the distance between the trailing edge of said front screed to the trailing edge of said rear screed, whereby the trailing edge of said rear screed is maintained at an equal elevation to the trailing edge of said front screed.

36. The paving machine of claim 32, wherein said first and second raising and lowering means comprise first and second hydraulic cylinders.

37. The paving machine of claim 36, wherein said second hydraulic cylinder actuated concurrently with actuation of said first hydraulic cylinder comprises said second hydraulic cylinder being connected in series with said first hydraulic cylinder.

38. The paving machine of claim 37, wherein the ratio of the diameter of said first hydraulic cylinder to said second hydraulic cylinder is equal to the ratio of the distance between the tow point and the trailing edge of said front screed to the distance between the trailing edge of said front screed and the trailing edge of said rear screed, whereby said rear screed is raised and lowered with respect to said front screed by a distance equal to the distance by which the leading edge of said front screed is raised or lowered.

39. The paving machine of claim 32, further comprising actuating means, operatively associated with said first and second means, for actuating said first means for raising and lowering said tow point with respect to said tractor means to lower said tow point to bring said front screed from a paving orientation to a stopped orientation with respect to the surface being paved, and for concurrently actuating said second means for raising and lowering said rear screed with respect to said front screed to lower said rear screed from a first position to a second position with respect to said front screed.

40. The paving machine of claim 39, wherein said actuating means is actuated in response to said paving machine stopping its forward movement.

41. The paving machine of claim 32, further comprising return means, operatively associated with said first and second means, for actuating said first means to raise said tow point to return said front screed from said stopped orientation to said paving orientation, and for concurrently actuating said second means to raise said rear screed from said second position to said first position with respect to said front screed.

42. The paving machine of claim 41 wherein said return means is actuated in response to said paving machine restarting its forward movement.

43. An apparatus for attachment to a paving machine for spreading and smoothing paving composition and the like, comprising:

a towing arm having a forward portion;

means for mounting the forward portion of said towing arm to said paving machine at a tow point vertically moveable with respect to said paving machine;

a screed mounted to said towing arm at a point thereon rearward of said tow point;

tow point adjustment means operatively associated with said towing arm for raising and lowering said tow point with respect to said paving machine, whereby said forward portion of said towing arm is raised and lowered to control the angle of said screed with respect to a surface being paved; and means operatively associated with said tow point adjustment means and actuated in response to stopping said paving machine for actuating said tow point adjustment means to lower said tow point to bring said screed from a paving orientation to a stopped orientation with respect to the surface being paved.

44. The apparatus of claim 43, further comprising means operatively associated with said tow point adjustment means and actuated in response to restarting said paving machine for actuating said tow point adjustment means to raise said tow point to return said screed from said stopped orientation to said paving orientation.

45. An apparatus for attachment to a paving machine for spreading and smoothing paving composition and the like, comprising;

a towing arm having a forward portion;

means for mounting the forward portion of said towing arm to said paving machine at a tow point vertically moveable with respect to said paving machine;

a screed mounted to said towing arm at a point thereon rearward of said tow point;

a hydraulic tow point cylinder operatively associated with said towing arm and having a piston mounted therein for reciprocal motion, said tow point cylinder being operative upon actuation thereof to raise and lower said tow point with respect to said paving machine;

means for introducing hydraulic fluid into said tow point cylinder on one side of said piston to raise said tow point with respect to said paving machine, and for introducing hydraulic fluid into said tow point cylinder on the other side of said piston to lower said tow point with respect to said paving machine; and means actuated in response to stopping said paving machine for introducing hydraulic fluid into said tow point cylinder on said other side of said piston to lower said tow point from a first tow point position to a second tow point position with respect to said paving machine to bring said screed from a paving orientation to a stopped orientation.

46. The apparatus of claim 45, further comprising means actuated in response to restarting said paving machine for introducing a quantity of hydraulic fluid into said tow point cylinder on said one side of said piston to raise said tow point from said second tow point position to said first tow point position to return said screed from said stopped orientation to said paving orientation.

47. An apparatus for attachment to a paving machine for spreading and smoothing paving composition and the like, comprising:

a towing arm having forward and back ends;

means for mounting the forward end of said towing arm to said paving machine at a tow point;

a screed mounted to the back end of said towing arm;

a hydraulic tow point cylinder having a piston mounted therein for reciprocal motion, said tow point cylinder having a lifting port on one side of said piston and a lowering port on the other side of said piston such that a hydraulic fluid introduced into one of said ports moves said piston and expels fluid from the other of said ports, said tow point cylinder being operative upon introduction of hydraulic fluid into said tow point hydraulic cylinder through said lifting port to raise said tow point with respect to said paving machine and operative upon introduction of hydraulic fluid into said tow point hydraulic cylinder through said lowering port to lower said tow point with respect to said paving machine, whereby the forward end of said towing arm is raised and lowered to control the angle of said screed with respect to a surface being paved; and means actuated in response to stopping said paving machine for introducing hydraulic fluid into said tow point cylinder through said lowering port to lower said tow point from a first tow point position to a second tow point position with respect to said paving machine to bring said screed from a paving orientation to a stopped orientation.

48. The apparatus of claim 47, further comprising means actuated in response to restarting said paving machine for introducing a quantity of hydraulic fluid into said tow point cylinder through said lifting port to raise said tow point from said second tow point position to said first tow point position to return said screed from said stopped orientation to said paving orientation.

* * * * *